US008179224B2

(12) United States Patent
Yen

(10) Patent No.: US 8,179,224 B2
(45) Date of Patent: May 15, 2012

(54) OVERCURRENT PROTECTION STRUCTURE AND METHOD AND APPARATUS FOR MAKING THE SAME

(76) Inventor: Chun-Chang Yen, Hsinchu (TW)

( * ) Notice: Subject to any disclaimer, the term of this patent is extended or adjusted under 35 U.S.C. 154(b) by 0 days.

(21) Appl. No.: 12/081,584

(22) Filed: Apr. 17, 2008

(65) Prior Publication Data

US 2010/0207716 A1 Aug. 19, 2010

(51) Int. Cl.
*H01H 85/04* (2006.01)
*H01H 85/38* (2006.01)
*H01H 69/02* (2006.01)

(52) U.S. Cl. ..... 337/273; 337/159; 337/166; 337/278; 337/282; 29/623

(58) Field of Classification Search ..... 337/159, 337/166, 273, 278, 282; 29/623
See application file for complete search history.

(56) References Cited

U.S. PATENT DOCUMENTS 3,911,385 A * 10/1975 Blewitt et al. ..... 337/202
4,091,353 A * 5/1978 Fisk et al. ..... 337/204
4,140,988 A * 2/1979 Oakes ..... 337/279
4,157,486 A * 6/1979 Fegley ..... 315/71
4,309,684 A * 1/1982 Wilks ..... 337/273
4,417,226 A * 11/1983 Asdollahi et al. ..... 337/273
4,503,415 A * 3/1985 Rooney et al. ..... 337/160
4,636,765 A * 1/1987 Krueger ..... 337/273
4,656,453 A * 4/1987 Reeder ..... 337/236
4,684,915 A * 8/1987 Knapp, Jr. ..... 337/276
4,873,506 A * 10/1989 Gurevich ..... 337/290
RE33,137 E * 12/1989 Gurevich et al. ..... 337/255
4,899,123 A * 2/1990 Asdollahi et al. ..... 337/273
4,918,420 A * 4/1990 Sexton ..... 337/205
4,924,203 A * 5/1990 Gurevich ..... 337/231
5,179,436 A * 1/1993 Asdollahi et al. ..... 337/203
5,198,791 A * 3/1993 Shibayama et al. ..... 337/31
5,280,261 A * 1/1994 Mollet ..... 337/158
5,406,245 A * 4/1995 Smith et al. ..... 337/273
5,572,181 A * 11/1996 Kiryu et al. ..... 337/273
5,664,320 A * 9/1997 Gurevich ..... 29/623
5,675,308 A * 10/1997 Scherer et al. ..... 337/186
5,714,923 A * 2/1998 Shea et al. ..... 337/159
5,774,037 A * 6/1998 Gurevich ..... 337/248
5,812,046 A * 9/1998 Brown et al. ..... 337/290
5,858,454 A * 1/1999 Kiryu et al. ..... 427/118
5,994,994 A * 11/1999 Ito et al. ..... 337/248
6,147,585 A * 11/2000 Kalra et al. ..... 337/248
6,222,438 B1 * 4/2001 Horibe et al. ..... 337/290
6,507,265 B1 * 1/2003 Ackermann ..... 337/278
6,664,886 B2 * 12/2003 Ackermann ..... 337/296
6,903,649 B2 * 6/2005 Ackermann ..... 337/296
7,119,652 B2 * 10/2006 Umeda ..... 337/282
7,320,171 B2 * 1/2008 Jollenbeck et al. ..... 29/623
2002/0041944 A1 * 4/2002 Stavnes et al. ..... 428/36.9
2003/0001716 A1 * 1/2003 Kaltenborn et al. ..... 337/273

(Continued)

*Primary Examiner* — Bradley Thomas
(74) *Attorney, Agent, or Firm* — Jackson IPG PLLC; Demian K. Jackson

(57) ABSTRACT

The overcurrent protection structure according to the present invention mainly comprises a fusible fuse structure unit disposed in a coating, and the both ends of the fusible fuse structure unit extend outwardly beyond the coating and form a first electrode and a second electrode. In the manufacturing process, the gas-assisted injection molding process enables at least one space for accommodating gas disposed between the fusible fuse structure unit and the coating such that the heat generated by the electrically energized the fusible fuse structure unit will not dissipate through the heat conduction of the coating in order to ensure that it will blow at high temperature when reaching a specific current or a specific temperature and the circuit protection effect.

7 Claims, 10 Drawing Sheets

U.S. PATENT DOCUMENTS

2004/0104801 A1* 6/2004 Jollenbeck et al. ..... 337/159
2006/0055497 A1* 3/2006 Harris et al. ..... 337/14
2006/0170332 A1* 8/2006 Tamaki et al. ..... 313/498
2007/0159292 A1* 7/2007 Chang et al. ..... 337/159
2008/0084267 A1* 4/2008 Jollenbeck et al. ..... 337/246

* cited by examiner

OVERCURRENT PROTECTION STRUCTURE AND METHOD AND APPARATUS FOR MAKING THE SAME

BACKGROUND OF THE INVENTION (a) Field of the Invention

The present invention relates to an overcurrent protection structure and a method and an apparatus for making the same, and more particularly to an overcurrent protection structure, which can ensure that the overcurrent protection structure would blow at high temperature when reaching a specific current or a specific temperature and the protection effect against excess current, and a method and an apparatus for making the same.

(b) Description of the Prior Art

A fuse is designed to protect electric circuits or electrical equipments in an electric circuit from the damage on sophisticated electronic instruments caused by an instantaneous excess current or an excess voltage. Therefore, the fuse is a necessary electronic component. A conventional fuse unit has a coil or a fuse material, and the fuse material is sealed in a tube made of hard glass, ceramic or other insulating materials. The insulating tube is filled therein with an inert gas or an arc resistant packing material. The both ends of the tube are electric conductors respectively, and the current can flow through the fuse by the connection of the electric conductors to the soldering joints on a circuit board. When an instantaneous current exceeds the predetermined current rating, the fuse material will blow at high temperature due to the heat induced by the instantaneous excess current so as to break the circuit. Thus, the excess current would stop flowing into the circuit to protect the electric circuits and electrical equipments from damage. When a fuse unit of such structures is used at a larger current (240 A) or at a high voltage (2250 V), the instantaneously generated energy would result in the high heat of the fuse blowout such that the surrounding media will expand rapidly and burst the tube. In the meantime, the arcs will occur so that it is easy to burn out the peripheral electronic components and damage expensive system equipments.

Therefore, the conventional structures of fuse unit and their manufacturing method mostly emphasize the suppression of arcs, such as U.S. Pat. No. 6,507,264, U.S. Pat. No. 5,572,181, U.S. Pat. No. 5,923,239, U.S. Pat. No. 6,507,265, U.S. Pat. No. 5,812,046, U.S. Pat. No. 5,596,306, and the like but their processes are relatively complicated. Accordingly, TW Patent 200727319 proposed an overcurrent protection element, as illustrated in FIG. 1. The overcurrent protection element 1 comprises a fuse body 11 and a fuse coating 12, wherein the both ends of the fuse body 11 respectively extend outwardly beyond the fuse coating 12 and form a first electrode 13 and a second electrode 14, and the fuse coating 12 is composed of a polymeric material. When the overcurrent protection element is in a condition of excess current, the fuse coating 12 can absorb the heat generated by the blowout of the fuse body 11 and suppress the occurrence of arcs.

However, in reality, when the fuse body 11 is electrically energized and generates heat, a part of the heat will dissipate through the heat conduction of the fuse coating 12 due to the contact of the fuse body 11 with the fuse coating 12 so that when a set excess current flows through the fuse body 11, the fuse body 11 cannot reach a specific current or a specific temperature and blow at high temperature. As a result, it is unable to achieve the circuit protection effect against excess current such that the electronic circuits of electrical devices would be damaged or burned out.

SUMMARY OF THE INVENTION

The primary objective of the present invention is to provide an overcurrent protection structure, which can ensure that the overcurrent protection structure would blow at high temperature when reaching a specific current or a specific temperature and the protection effect against excess current, and a method and an apparatus for making the same.

To achieve the above objective, the overcurrent protection structure according to the present invention mainly comprises a fusible fuse structure unit disposed in a coating, and the both ends of the fusible fuse structure unit extend outwardly beyond the coating and form a first electrode and a second electrode. In the manufacturing process, a gas-assisted injection molding process enables at least one space for accommodating gas disposed between the fusible fuse structure unit and the coating such that the heat generated by the electrically energized the fusible fuse structure unit will not dissipate through the heat conduction of the coating in order to ensure that it will blow at high temperature when reaching a specific current or a specific temperature and the circuit protection effect against excess current.

DETAILED DESCRIPTION OF THE PREFERRED EMBODIMENTS

Figure 1:
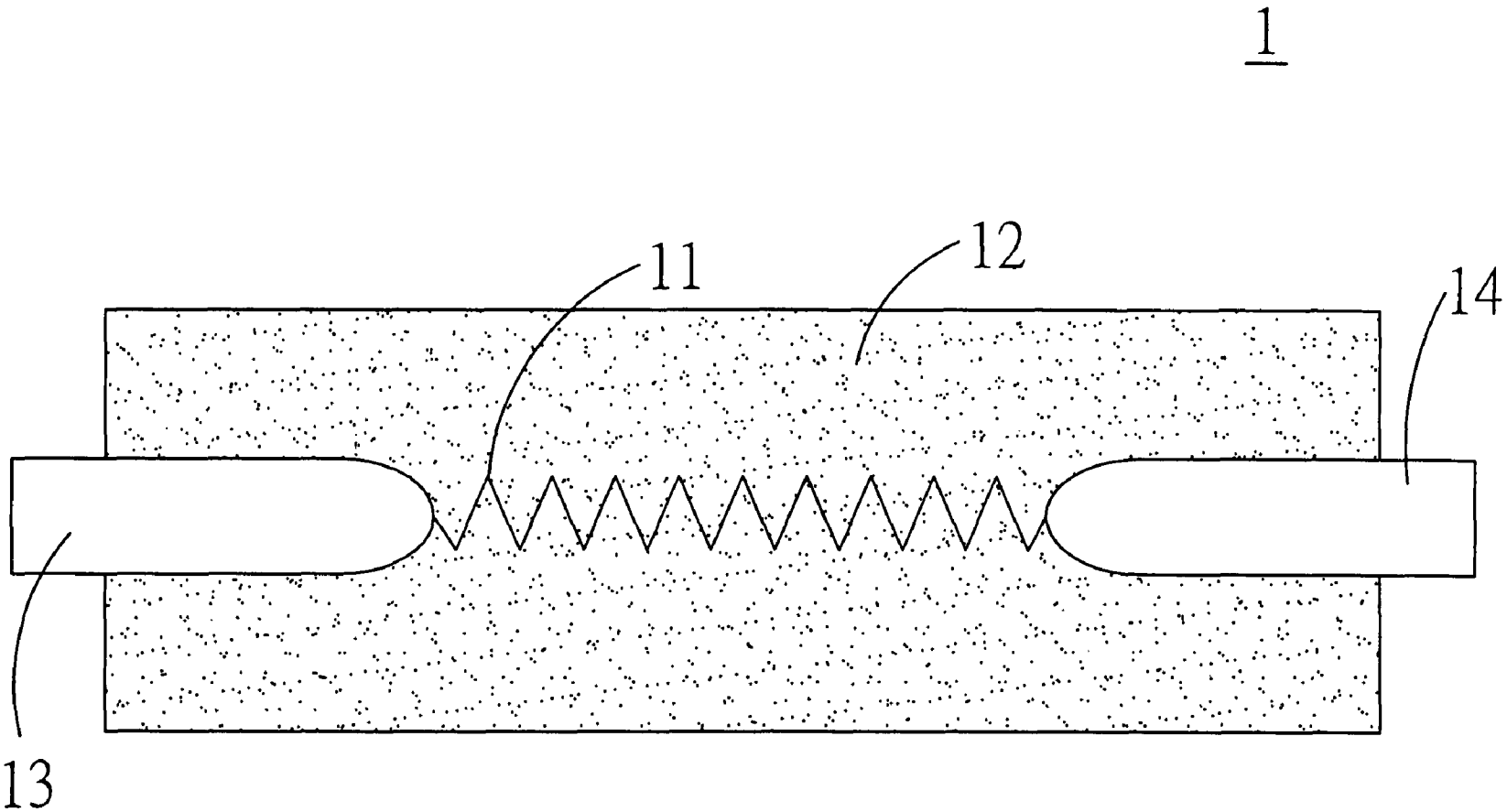
FIG.1 PRIOR ART
FIG. 1 is a schematic view showing a structure of an overcurrent protection element of the prior art.
Figure 2:
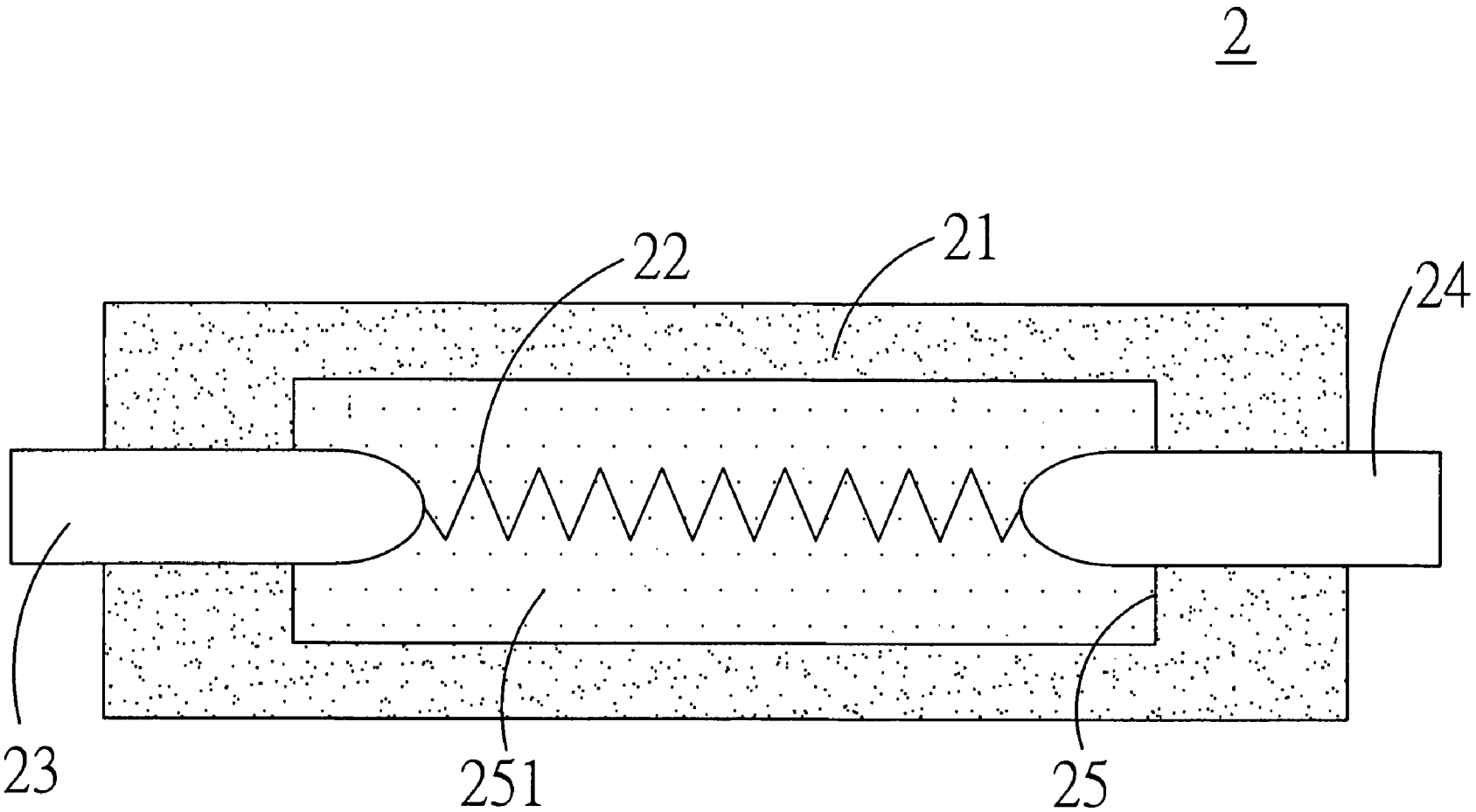
FIG. 2 is a schematic view showing a structure of an overcurrent protection structure according to the present invention.

The present invention is related to an overcurrent protection structure and a method and an apparatus for making the same. As illustrated in FIG. 2, the overcurrent protection structure 2 mainly includes a fusible fuse structure unit 22 disposed in a coating 21. The fusible fuse structure unit 22 is a copper wire or a copper alloy wire with the length of 10 mm and the diameter of 0.13 mm. It is in turn plated with a 10 μm thick silver layer and a 6 μm thick tin layer. The both ends of the fusible fuse structure unit 22 extend outwardly beyond the coating 21 and form a first electrode 23 and a second electrode 24, wherein at least one space 25 is disposed between the fusible fuse structure unit 22 and the coating 21 and the space 25 is further filled with gas 251, such an inert gas as nitrogen gas, helium gas, and the like.

Figure 3:
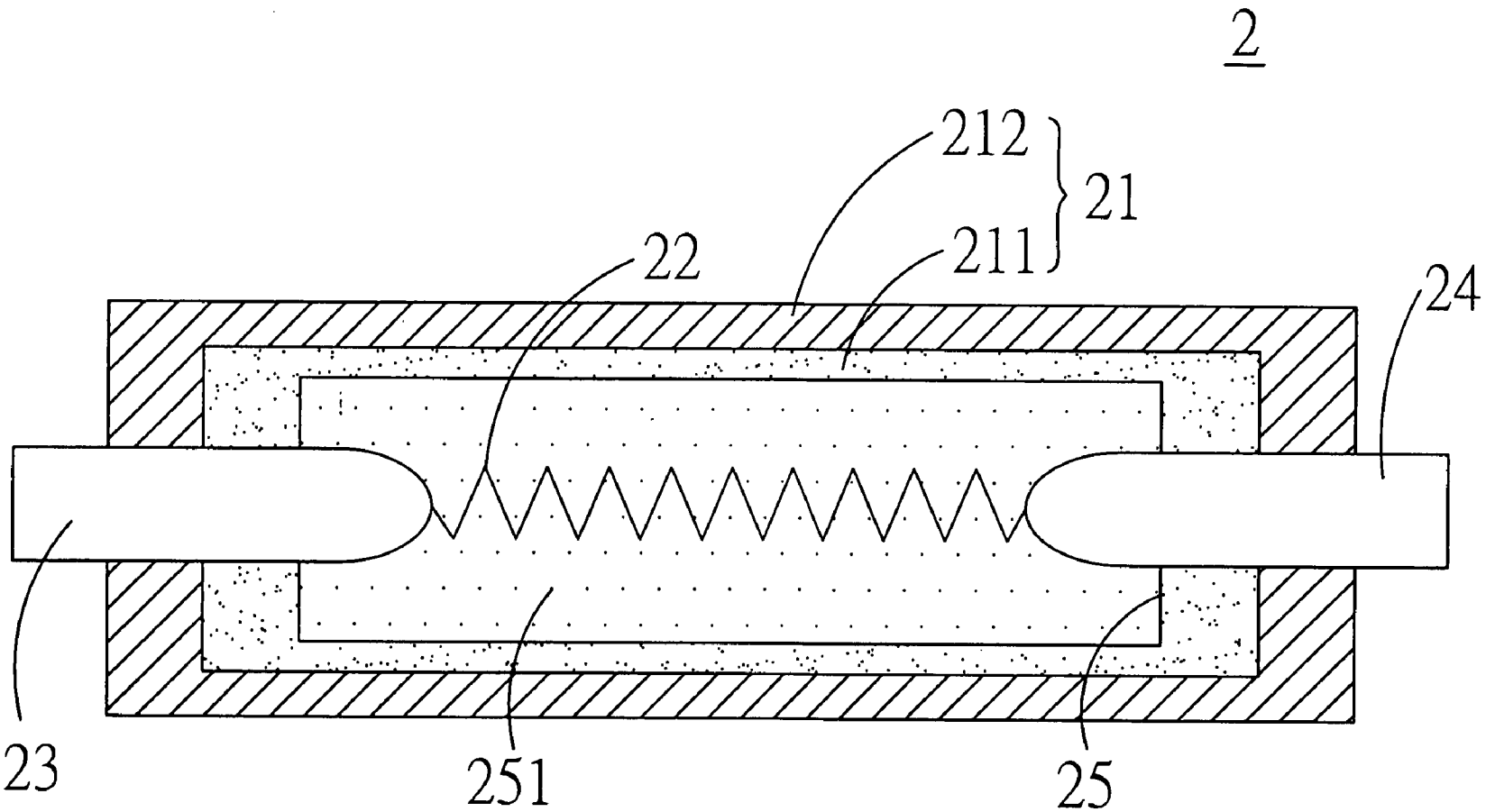
FIG. 3 is a schematic view showing another structure of an overcurrent protection structure according to the present invention.

The coating 21 can be an arc resistant material, which can be a thermoplastic material or a thermosetting material. Wherein the thermoplastic material includes (a) crystalline polymeric material: polyethylene, polypropylene, polytetrafluoroethylene, nylon 12, nylon 6, nylon 66, nylon 6T, nylon 9T, polybutylene terephthalate, polyethylene terephthalate, polyoxymethylene, PEEK, liquid crystal polymers, ethylene copolymers, polyethersulfone, polyphenylene sulfone; (b) amorphous polymeric material: acrylonitrile-butadiene-styrene terpolymer, polystyrene, polycarbonate, polysulfonate, polydiethyl ether sulfonate, polystyrene oxide, phenoxy resin, polyamide, polyether amide, polyether amide/silicon block copolymer, polycarboxylate, propylene resin, polymethacrylate, styrene/propylene-trichloroethylene, poly(4-methylpent-1-ene), styrene block copolymer. And the thermosetting material can be epoxy resin, phenolic resin, unsaturated polyester resin, urea resin, melamine resin, polyimide resin and silicone resin, and the like. Furthermore, the above thermoplastic material or thermosetting material filled with a hydrated inorganic material can also be used as the arc resistant material, and the hydrated inorganic material is, for example, aluminum hydroxide trihydrate or magnesium hydroxide dihydrate. It is understood that the coating 21 can also be formed with an inner layer 211 and an outer layer 212, as illustrated in FIG. 3. The inner layer 211 can be made of an arc resistant material and the outer layer 212 can be made of an ordinary coating material so as to decrease the use of the arc resistant material, thereby further reducing the cost.

Figure 4:
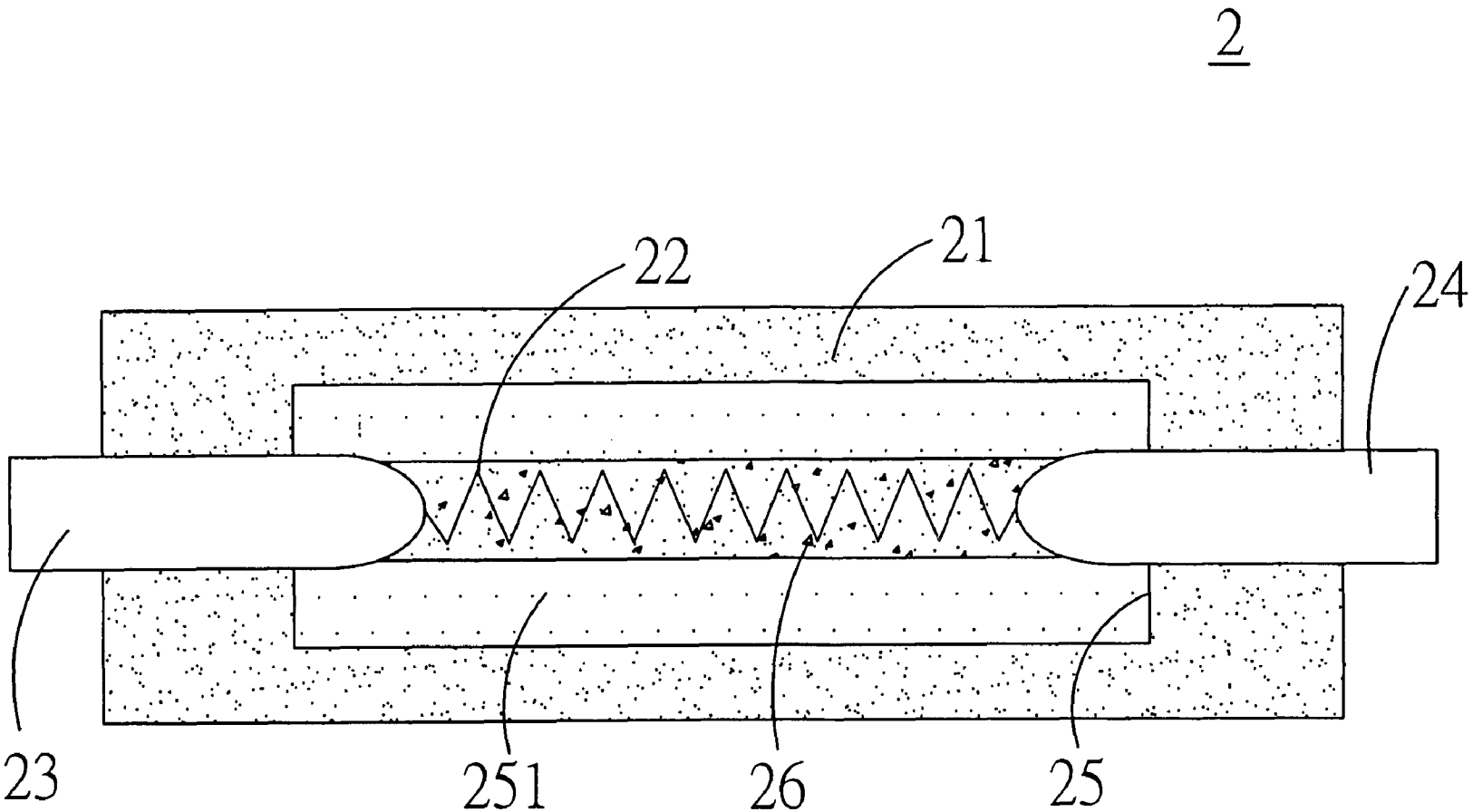
FIG. 4 is a schematic view showing another structure of a fusible fuse structure unit according to the present invention.

In the overcurrent protection structure 2 according to the present invention, the coating 21, which encapsulates the fusible fuse structure unit 22, is formed by means of an arc resistant material and a gas-assisted injection molding process, and the space 25 between the fusible fuse structure unit 22 and the coating 21 is simultaneously formed. Accordingly, when the overcurrent protection structure is in a condition of excess current, the coating 21 can absorb the heat generated by the blowout of the fusible fuse structure unit 22 and suppress the occurrence of arcs. The fusible fuse structure unit 22 can make no contact with the coating 21 directly by the space 25 such that the heat from the fusible fuse structure unit 22 will not dissipate through the heat conduction of the coating 21 in order to ensure that the fusible fuse structure unit 22 will blow at high temperature due to a specific current or a specific temperature, thereby achieving the circuit protection effect against excess current. Besides, the outside of the fusible fuse structure unit 22 can be further coated with a thermal insulating material 26 with arc resistance, as illustrated in FIG. 4.

Figure 5:
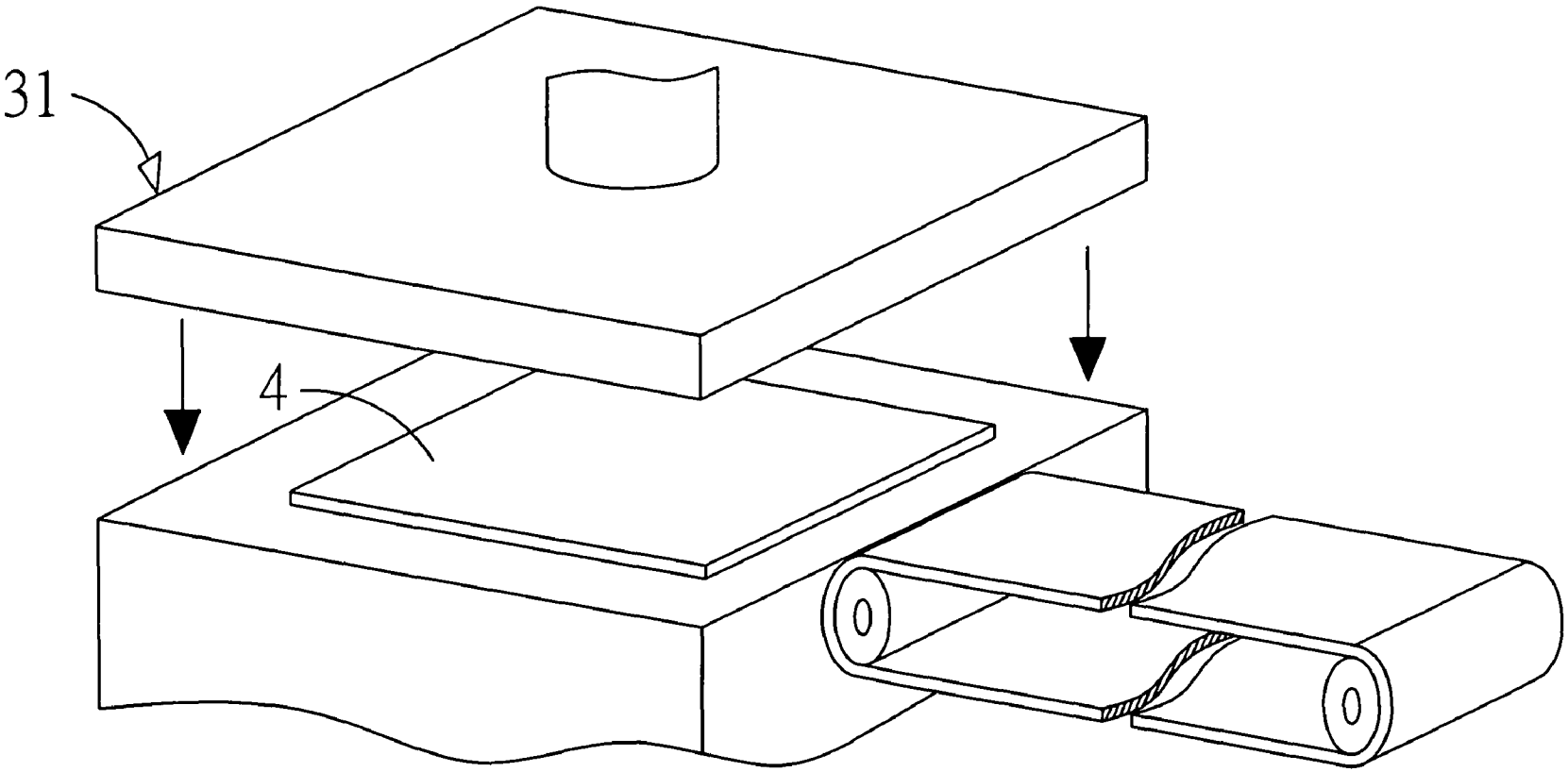
FIG. 5 is a schematic view showing a structure of stamping a lead frame in a stamping unit according to the present invention.
Figure 6:
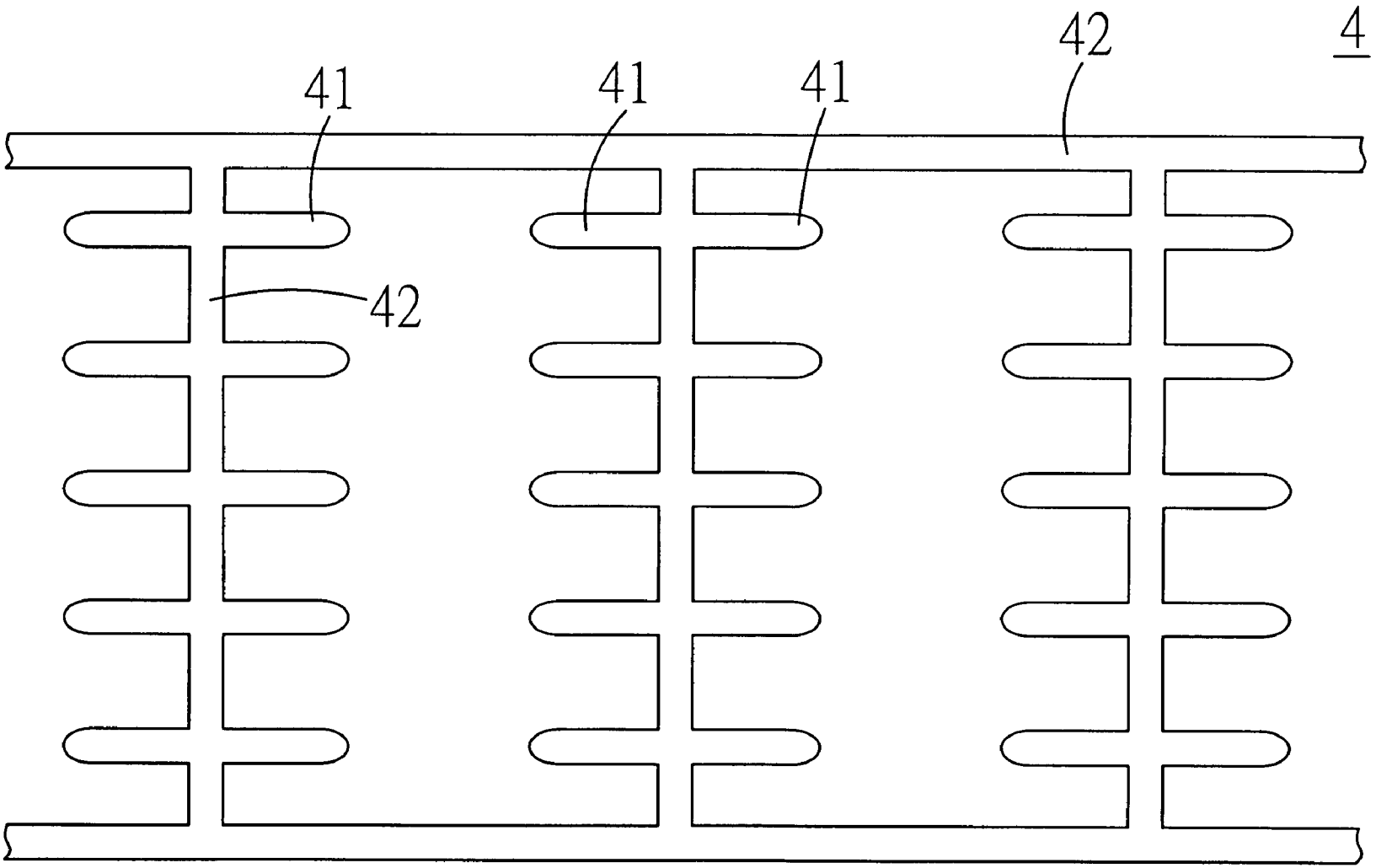
FIG. 6 is a schematic view showing a structure of a lead frame after stamping according to the present invention.
Figure 7:
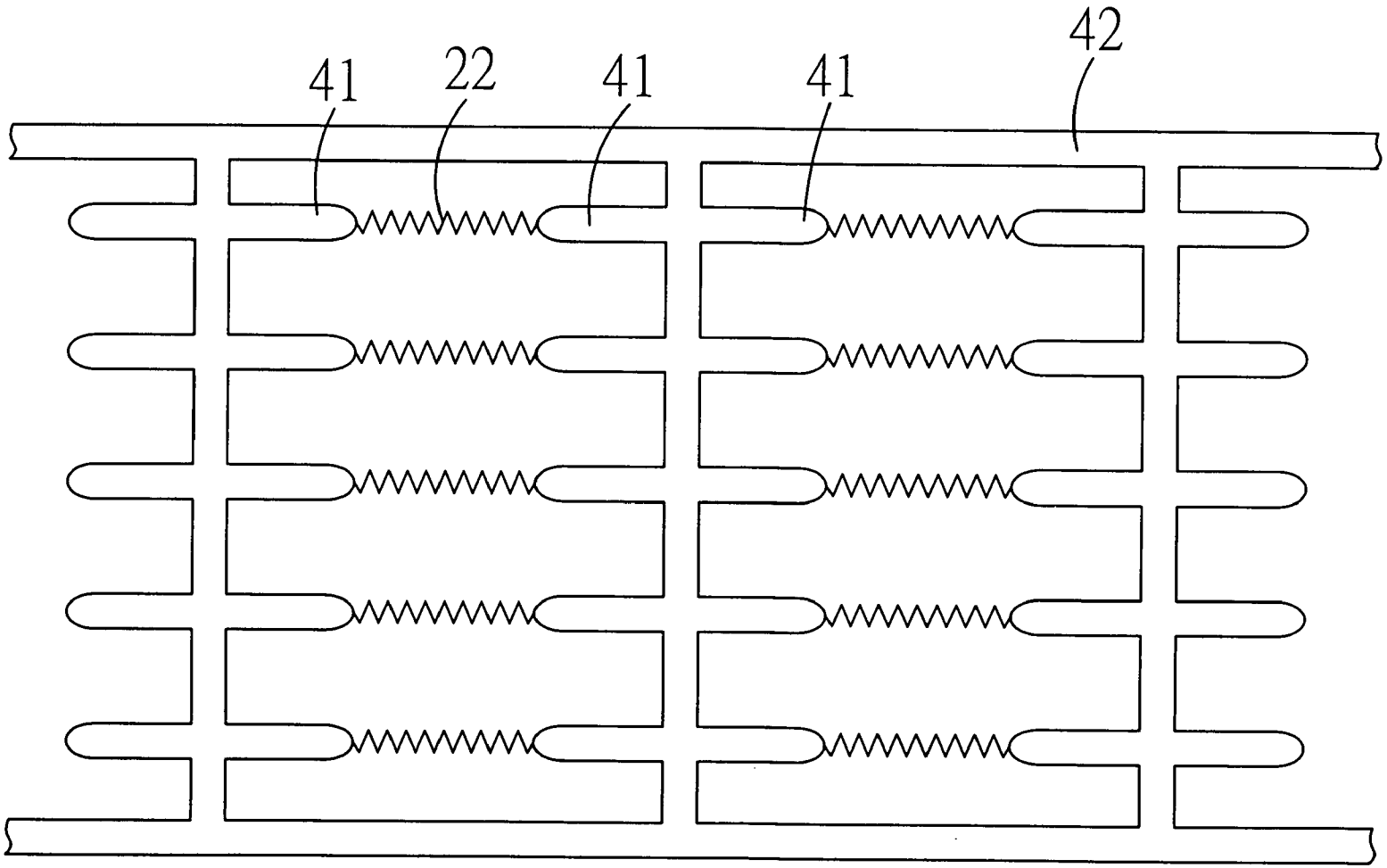
FIG. 7 is a schematic view showing a structure of fusible fuse structure units soldered between each supporting unit according to the present invention.
Figure 8:
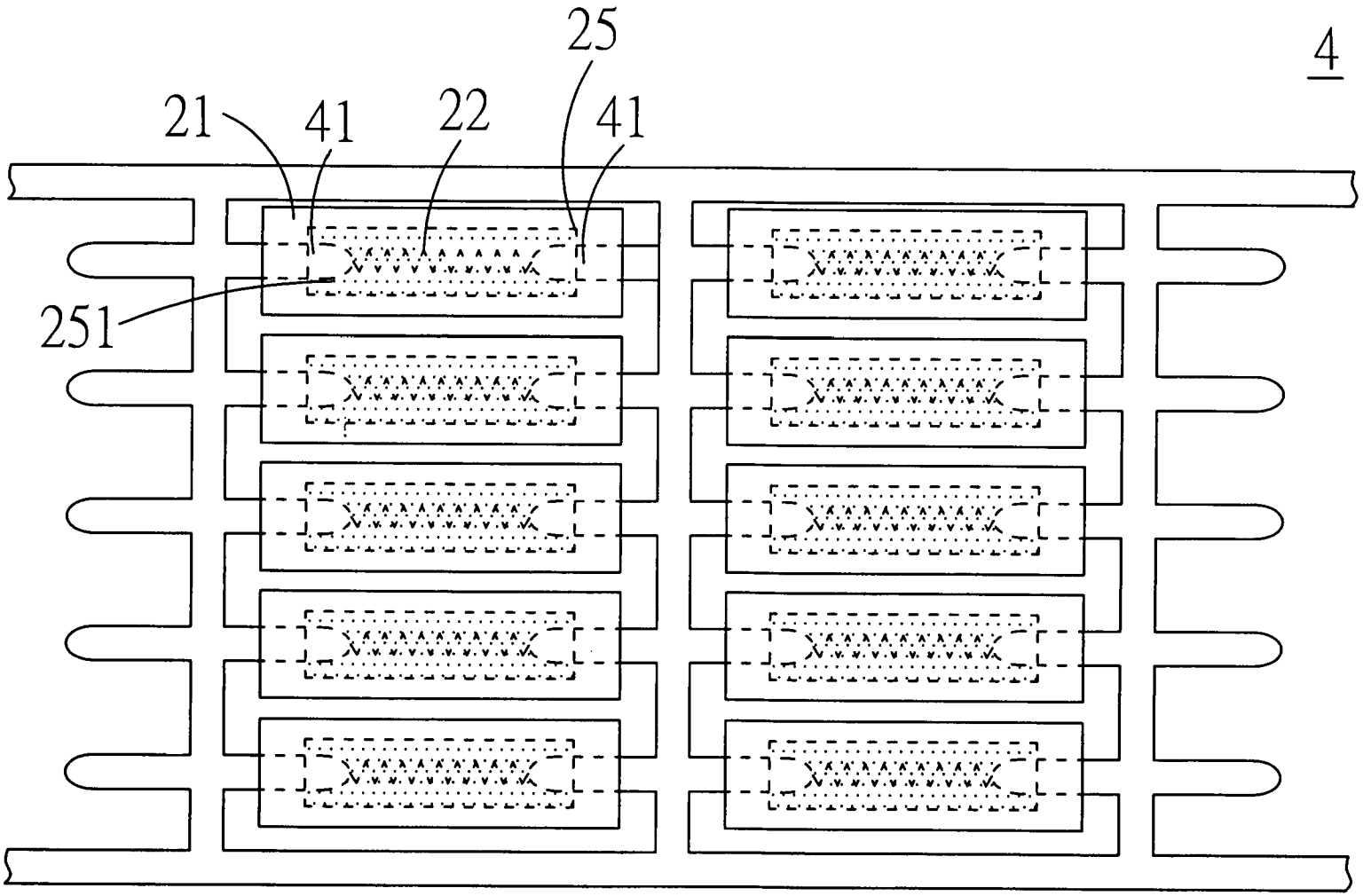
FIG. 8 is a schematic view showing a structure of coatings injection molded onto a lead frame according to the present invention.
Figure 9:
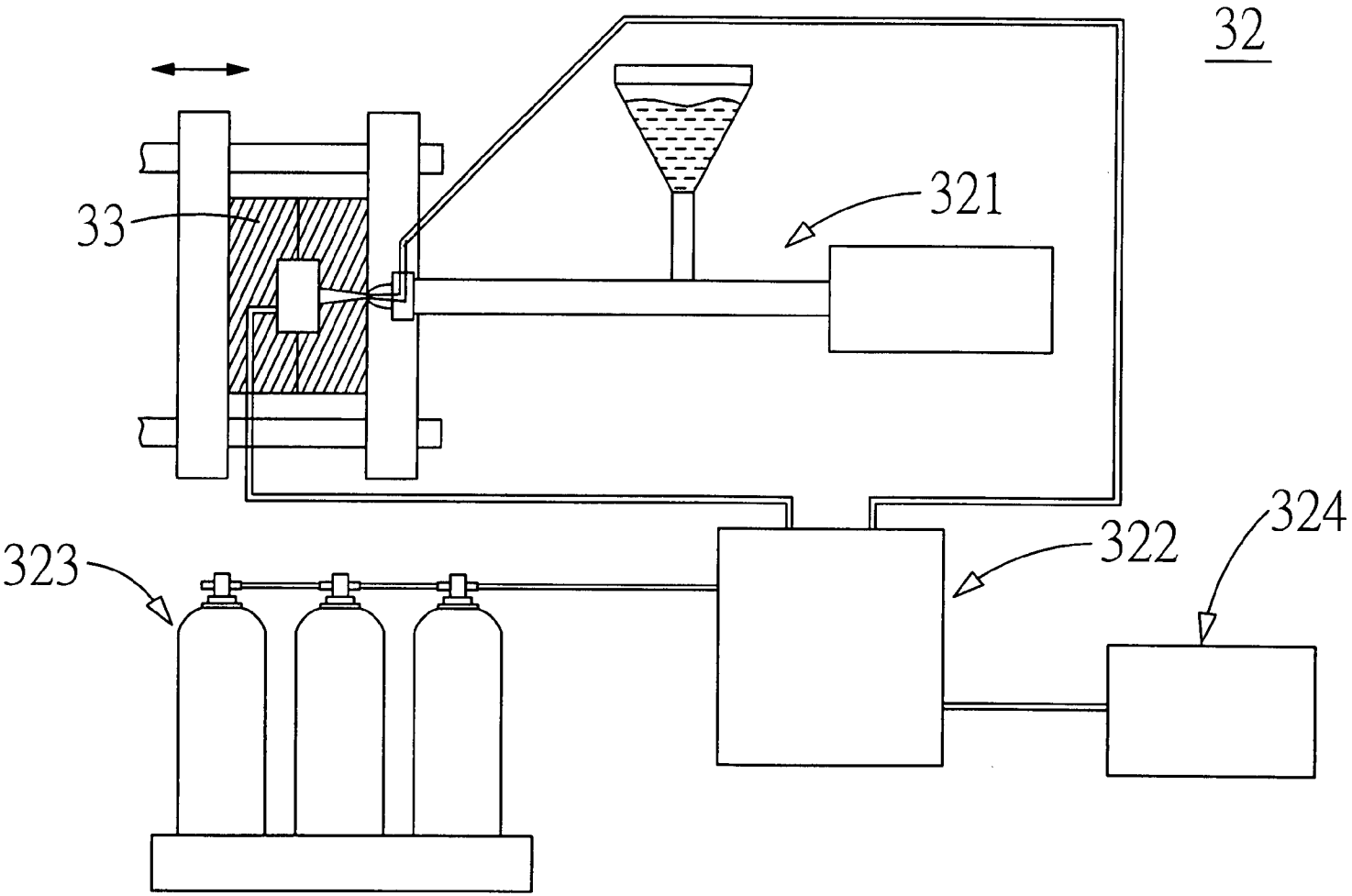
FIG. 9 is a schematic view showing a structure of a gas-assisted injection molding unit according to the present invention.
Figure 10:
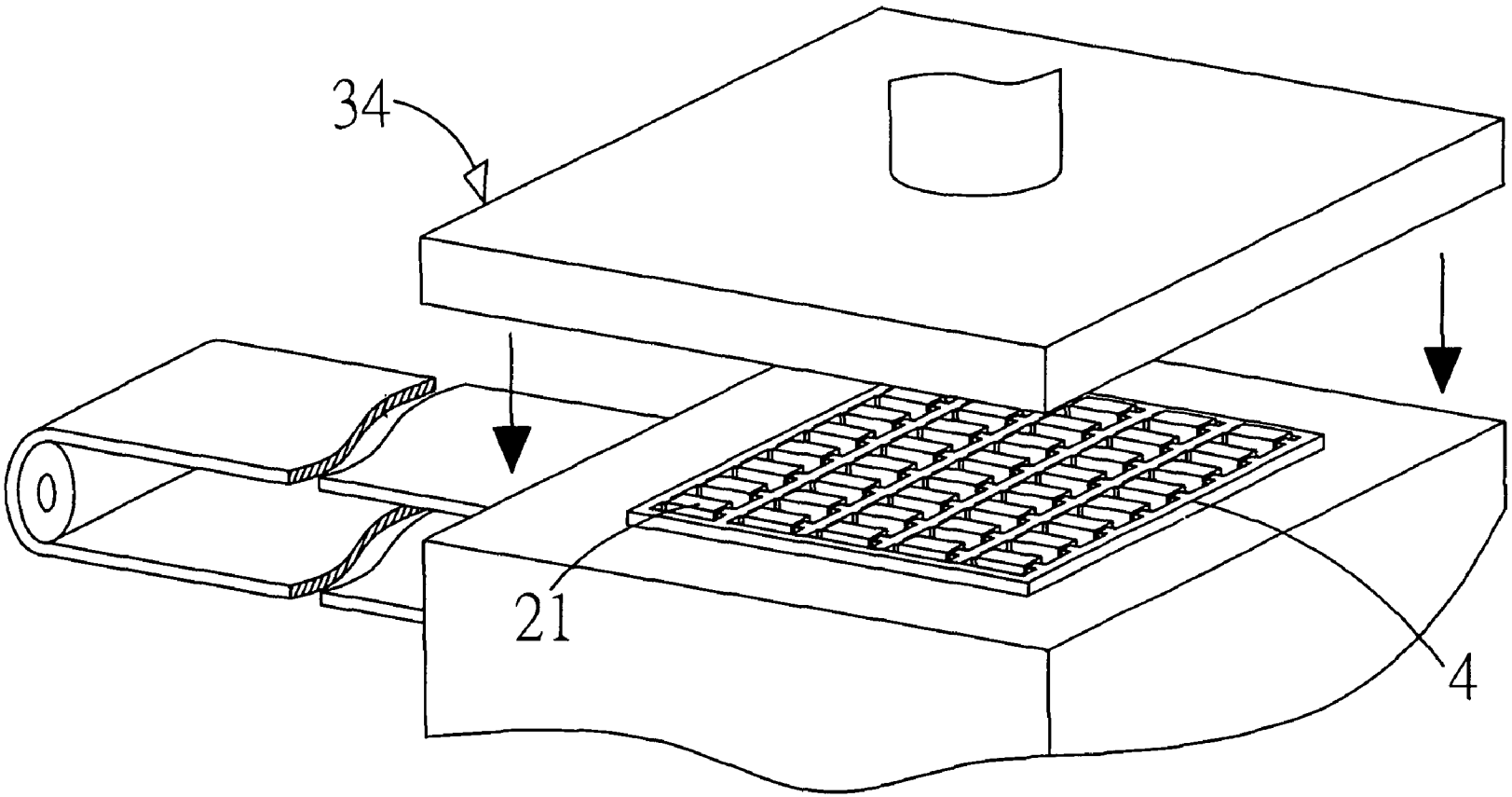
FIG. 10 is a schematic view showing a structure of cutting a lead frame in a cutting unit according to the present invention.

The manufacturing apparatus for an overcurrent protection structure according to the present invention at least comprises a stamping unit, a soldering unit, a gas-assisted injection molding unit, a cutting unit and a transporting unit located between each unit as described above, whereby the steps are performed as follows:

Step A: providing a lead frame;

Step B: performing a stamping process by using the stamping unit 31 to form a plurality of supporting units 41 and a connection unit 42 for connecting each supporting unit 41 on the lead frame 4, as illustrated in FIGS. 5 and 6;

Step C: disposing the fusible fuse structure units 22 between the supporting units 41, as illustrated in FIG. 7, and securely soldering the fusible fuse structure units 22 to the supporting units 41 via a soldering unit;

Step D: performing a gas-assisted injection molding process by using the gas-assisted injection molding unit to mold the coatings 21 which encapsulate the fusible fuse structure units 22 and a part of the supporting units 41 by using injection, as illustrated in FIG. 8, and at least one space 25 for accommodating gas 251 being disposed between the fusible fuse structure units 22 and the coatings 21, also referring to FIG. 9, positioning the stamped lead frame 4 in a mold 33, then performing a gas-assisted injection molding process, the gas-assisted injection molding unit 32 at least comprising an injection molding machine 321, a gas-assisted injection apparatus 322, a gas generator 323 and an air compressor 324, wherein the injection molding machine 321 can contain the arc resistant material such that the arc resistant material and the gas are simultaneously injected into the mold 33, as a matter of course, the arc resistant material can be the thermoplastic material or thermosetting material and the thermoplastic material or thermosetting material filled with a hydrated inorganic material as mentioned above; and Step E: performing a cutting process, as illustrated in FIG. 10, to cut the connection unit 42 by a cutting unit 34, as illustrated in FIG. 2, to form the overcurrent protection structures. The portions of the supporting unit emerging from the coating 21 are formed as the first electrode 23 and the second electrode 24.

Moreover, in step D, the gas-assisted injection molding process is combined with a coinjection system, that is, the gas-assisted injection molding unit at least comprises a coinjection molding machine, a gas-assisted injection apparatus, a gas generator and an air compressor. The coinjection molding machine contains the arc resistant material and ordinary material such that the molded coating 21 is formed with the inner layer 211 and the outer layer 212, as illustrated in FIG. 3. And the inner layer 211 can be made of the arc resistant material and the outer layer 212 can be made of the ordinary coating material.

It should be noted that the present invention when compared to the prior art provides the following advantages:

1. The coating according to the present invention is made of an arc resistant material, and said coating can absorb the heat generated by the blowout of the fusible fuse structure unit and suppress the occurrence of an arc.

2. The arc resistant material according to the present invention can be a thermoplastic material or a thermosetting material filled with magnesium hydroxide dihydrate. The coating will release water of crystallization until its temperature reaches 340° C. so that it is more suitable for the current lead-free solder system with the melting point of the lead-free solder being about 210-230° C., and the thermal endurance and the arc resistance of that containing magnesium hydroxide dihydrate are better.

3. At least one space for accommodating gas is disposed between the fusible fuse structure unit and the coating to make the fusible fuse structure unit in no contact with the coating directly such that the heat generated by the electrically energized the fusible fuse structure unit will not dissipate through the heat conduction of the coating in order to ensure that it will blow at high temperature when reaching a specific current or a specific temperature, thereby ensuring the circuit protection effect.

The technical contents and features of the present invention are disclosed above. However, anyone who familiars with the technique could possibly make change or modify the details in accordance with the present invention without departing from the technological ideas and spirit of the invention. Therefore, the protection scope of the present invention shall not be limited to what embodiment discloses, and should include various modification and changes that are made without departing from the technological ideas and spirit of the present invention, and should be covered by the claims mentioned below.

I claim:

1. An overcurrent protection structure comprising:

a coating made of an arc resistant material comprising a thermoplastic material or a thermosetting material, the arc resistant material further being filled with magnesium hydroxide dihydrate such that the coating absorbs heat and releases water of crystallization until a temperature in excess of a lead-free solder melting point is reached;

a fusible fuse structure unit, which is encapsulated by the coating, wherein a gas filled space exists between the fusible fuse structure unit and the coating, the gas filled space extending along at least a full length of the fusible fuse structure unit, such that the fusible fuse structure makes no direct contact with the coating to prevent the heat generated by the fusible fuse structure unit from dissipating through the gas filled space to the coating; and a first electrode and a second electrode, which are respectively lead-free soldered to both ends of the fusible fuse structure unit and extend outwardly beyond the coating.

2. The overcurrent protection structure as claimed in claim 1, wherein the coating is formed with two layers comprising an inner layer made of the arc resistant material and an outer layer made of coating material.

3. The overcurrent protection structure as claimed in claim 1, wherein the outside of the fusible fuse structure unit is further coated with a thermal insulating material with arc resistance.

4. The overcurrent protection structure as claimed in claim 1, wherein the first electrode and the second electrode are formed by lead frame stamping.

5. The overcurrent protection structure as claimed in claim 1, wherein the space is further filled with an inert gas.

6. The overcurrent protection structure as claimed in claim 5, wherein the coating and the gas in the space are molded by gas-assisted injection.

7. The overcurrent protection structure as claimed of claim 1, wherein the coating absorbs heat and releases water of crystallization until a temperature of 340 Celsius is reached.

* * * * *